US006225740B1

(12) United States Patent
Tucker et al.

(10) Patent No.: US 6,225,740 B1
(45) Date of Patent: May 1, 2001

(54) ELECTROLUMINESCENT LAMPS

(75) Inventors: John Kenneth Tucker; William John Kearns, both of Christchurch (NZ)

(73) Assignee: Screen Sign Arts, Ltd., Christchurch (NZ)

( * ) Notice: Subject to any disclaimer, the term of this patent is extended or adjusted under 35 U.S.C. 154(b) by 0 days.

(21) Appl. No.: 09/127,412

(22) Filed: Jul. 31, 1998

(30) Foreign Application Priority Data

Jan. 28, 1998 (NZ) ..... 329652

(51) Int. Cl.[7] ..... H01J 01/62; H01J 63/04

(52) U.S. Cl. ..... 313/506; 313/507; 313/509; 313/512

(58) Field of Search ..... 313/483, 506, 313/507, 509, 502, 512

(56) References Cited

U.S. PATENT DOCUMENTS 5,432,015 * 7/1995 Wu et al. ..... 313/509
5,508,585 * 4/1996 Butt ..... 313/509
5,789,860 * 8/1998 Inoguchi et al. ..... 313/509 X
5,976,613 * 11/1999 Janusauskas ..... 313/509 X

* cited by examiner

*Primary Examiner*—Nimeshkumar D. Patel
*Assistant Examiner*—Mack Haynes
(74) *Attorney, Agent, or Firm*—Jacobson, Price, Holman & Stern, PLLC

(57) ABSTRACT

An improved electroluminescent display includes a first substantially transparent or translucent conductive layer and a phosphor or the like layer. The layers are deposited to form a multi-element display on the first conductive layer; with the phosphor layer broken up into more than one area. There is a layer of dielectric deposited upon the phosphor or the like layer and the dielectric covers substantially all of the display with a second conductive layer deposited upon the dielectric layer. The areas correspond to areas of the electroluminescent display which are to be lit. The second conductive layer is comprised of a number of areas shaped to be substantially congruent with the shaped areas of the phosphor or the like layer.

7 Claims, 3 Drawing Sheets

ELECTROLUMINESCENT LAMPS

FIELD OF THE INVENTION

The invention relates to improvements in electroluminescent signs, methods for manufacturing same and methods and apparatus for operating same. More particularly, although not exclusively, the present invention relates to improvements in electroluminescent (EL) lamps where the lamps are in the form of multi-element (or multi-lamp) displays operated so as to provide the illusion of animation or where a specified sequential activation of lamps or groups of lamps in an EL displays may be desired. The present invention also relates to static EL displays.

BACKGROUND TO THE INVENTION

Electroluminescent (EL) lamps are well-known. An EL lamp can be thought of as a thin capacitor having a dielectric sandwiched between the electrodes of the capacitor, with at least one electrode being transparent. When an alternating electric field is applied to the capacitor, particles having electroluminescent properties (e.g.; phosphor) suspended in the dielectric, emit light.

One aspect of EL lamp display technology which has previously posed a number of problems is in the design of multi-lamp EL displays. This type of display has a number of EL lamps printed on a single sheet. In such situations, the requirements of adhesion, providing conductive paths, supplying the power supply waveform to various parts of the display as well as providing the required degree of physical resilience, may be difficult to meet.

Known methods of fabricating single and multi-lamp displays have not been ideal in that, when laying conductive paths (or 'traces') on an insulating UV dielectric material, adequate adhesion to the adjacent substrate has been difficult to achieve. Further, the electrode shape (and therefore illuminated EL lamp shape) may need to have overlaid thereon conductive traces, the number of which depending on the 2-dimensional topology of the EL display. The shapes of the desired EL lamp is governed by the two dimensional shape (or 'image') of the electrodes at the back of the EL display and the phosphor. These electrodes are usually in the form of a silver conductive layer applied to a phosphor and dielectric layer combination. A known method of passing conduction traces over conductive areas of the EL display is to lay tracks of UV dielectric along the desired conduction path (usually between the power supply terminals and the rear electrode), lay down a silver conductive trace and then apply a layer of UV dielectric over the top of the trace. This insulates the trace from both the rear electrode and the front electrode areas which are exposed between lamp elements. The specifics of this technique will be discussed in more detail below.

Problems have previously been encountered at the point where traces 17 pass over the edge of a particular electrode ("B" in FIG. 2). At this point, the edge of the electrode can be thought of as a step when viewed in cross-section. At this point, the UV dielectric layers (30, 16*a*, 16*b*) and the trace 17 must traverse a relatively sharp discontinuity at the edge of the electrode (14*a*, 14*b*). This can lead to thin spots in the silver trace at the step. Such thin spots are known to be prone to burnout resulting in lamp failure. A further problem is that the UV dielectric is known to be prone to cracking at the points where the trace terminates.

In multi-lamp displays, it is usually necessary to lay a relatively large number of traces across various sections of the EL display. Such traces must be effectively insulated from any electrode material (front or rear) or other trace sections over which they pass. Where possible traces are routed around various parts of the lamp display. However, for complex display topologies, it is often necessary to lay these traces directly over the top of any electrode areas while avoiding the creation of any unwanted conduction paths between the electrode and the power supply conduction trace.

Accordingly, it is an object of the invention to provide an improved EL lamp having enhanced resilience, reduced susceptibility to thin spots and hence burnout as well as increased longevity coupled with an ability to be driven at increased lamp brightness levels. A further object of the present invention is to provide the public with a useful choice.

SUMMARY OF THE INVENTION

In one aspect the invention provides an improved electroluminescent display comprising:

- a first substantially transparent or translucent conductive layer;
- a phosphor layer deposited on the first conductive layer;
- a layer of dielectric deposited upon the phosphor layer; and
- a second conductive layer deposited upon the dielectric layer.

The first conductive layer may correspond to an Indium Tin Oxide layer deposited onto a substantially transparent or translucent polyester sheet.

The phosphor layer may be broken up into one or more areas, with the areas corresponding to areas of the electroluminescent display that are to be lit. The second conductive layer is comprised of a number of areas shaped to be substantially congruent with the shaped areas of phosphor. A layer of dielectric material is interposed to the phosphor and the second conductive layer, and the dielectric layer covers substantially all of the display.

In an alternative embodiment, the dielectric layer may cover an area linking one or more phosphor areas.

Preferably, the layer of dielectric material is substantially opaque more preferably white.

Preferably the dielectric layer covers the entire electroluminescent display, the display comprising a number of areas, each area comprising congruent layers of phosphor and electrode material.

In a preferred embodiment, the phosphor corresponds to a blue-green phosphor.

In a further aspect, the display may include conduction paths traversing the phosphor/conductive layer areas, the conduction paths being insulated from the first and second conductive layers by means of a plurality of dielectric insulators.

Preferably the dielectric insulators correspond to a first dielectric layer interposed between the dielectric layer and a second conductive layer and a second dielectric layer deposited on the second conductive layer.

Preferably, the conduction paths are deposited on to the dielectric layer deposited onto the second electrode.

The present invention also provides a method of fabricating an improved EL lamp as hereinbefore described.

DESCRIPTION OF THE DRAWINGS

The invention will now be described by way of example only and with reference to the drawings in which.

DESCRIPTION OF THE INVENTION

Figure 1:
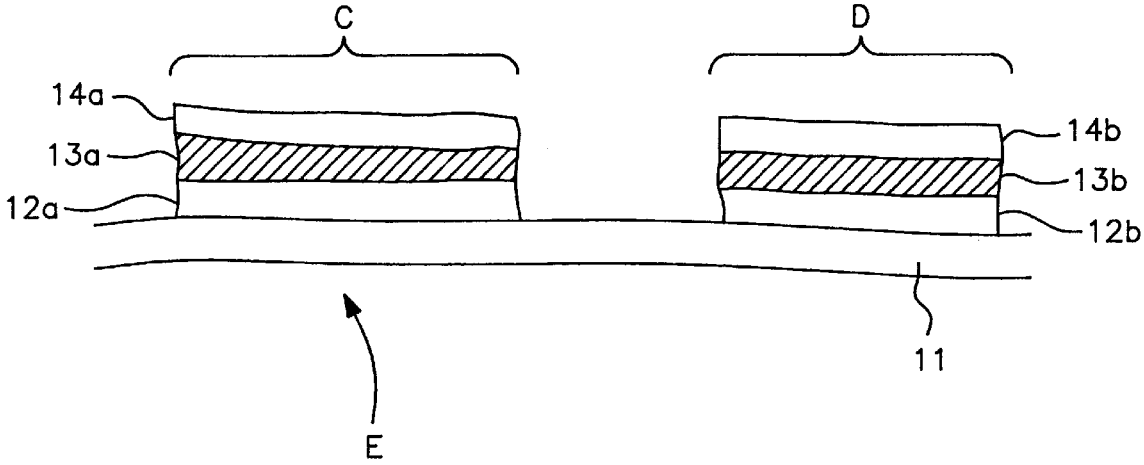
FIG. 1 (PRIOR ART)
FIG. 1 illustrates a cross-section through a prior art electroluminescent display.

Referring to FIG. 1, a prior art two element electroluminescent display is shown in cross-section.

The vertical dimensions of the various layers shown in the cross-sections illustrated in FIGS. 1–4, are significantly exaggerated for the purposes of clarity. In practice, each of the layer thicknesses are of order of tens of microns.

Figure 4:
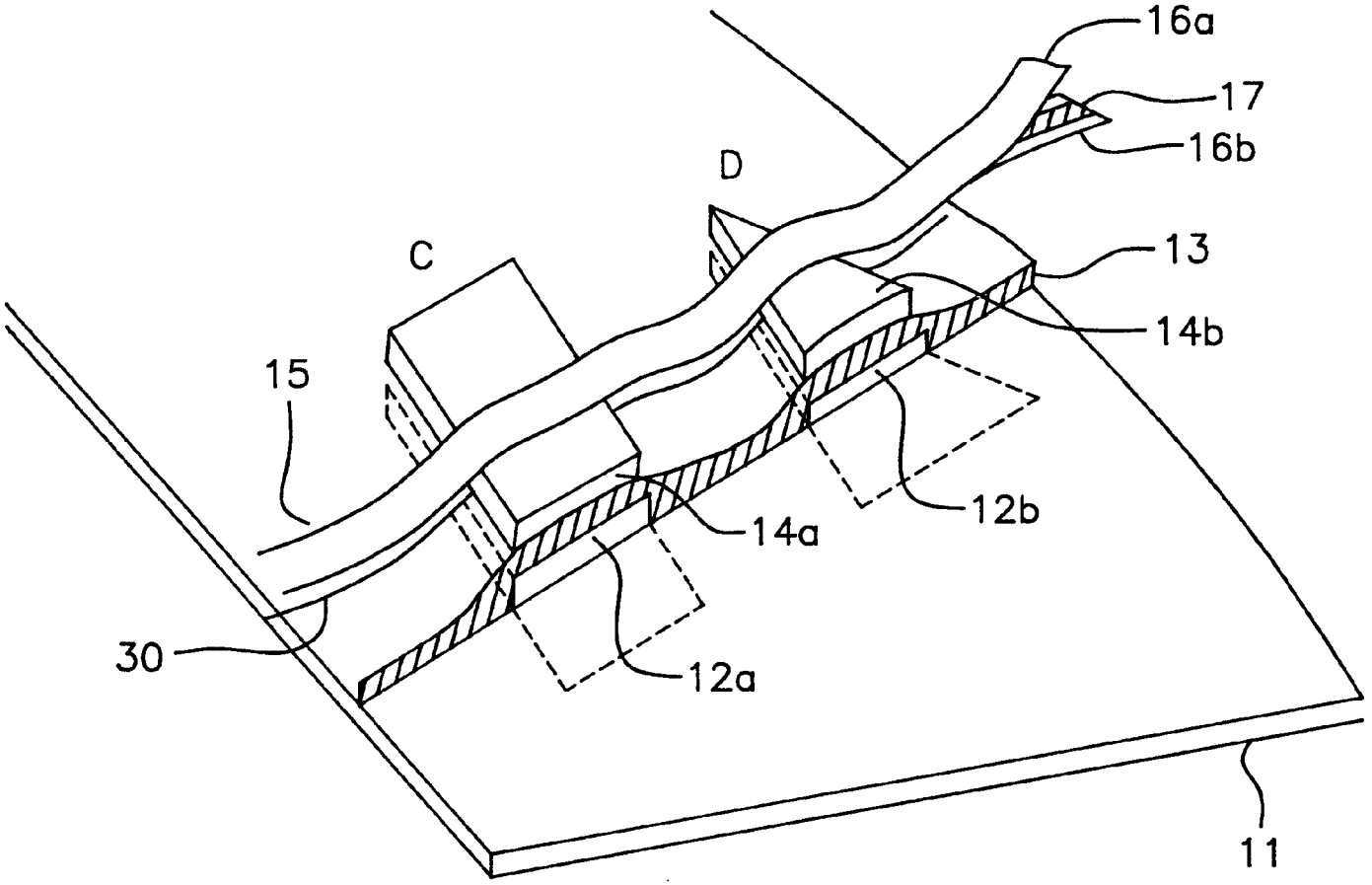
FIG. 4 illustrates a cutaway perspective an improved electroluminescent display having two lamps.

The two element electroluminescent display shown in FIG. 1 includes two lamp elements C and D. The lamp elements are deposited upon a transparent front electrode 11. The transparent front electrode is in the form of an indium tin oxide (ITO) layer printed or deposited onto a clear or translucent polyester sheet. A mylar layer 50 covers the lamp substrate 11 and protects the face of the display. Referring to lamp C, a phosphor layer 12*a* is deposited on the transparent front electrode 11 in the desired shape (when viewed in the direction "E" in FIG. 1). As can be seen in FIG. 4, lamp C corresponds to a rectangular shape or area and lamp D to a triangular shape or area.

Dielectric layer 13*a* is then printed on the phosphor layer 12*a*. The image, that is—the shape when viewed in plan view, formed by the dielectric layer is substantially the same as the phosphor layer below it. However, the dielectric layer may be slightly larger around the perimeter of the phosphor area by approximately 2 mm. A rear electrode 14*a* is then deposited on top of the dielectric layer thus completing the capacitor-like structure of the electroluminescent lamp. The dielectric layer 13 has electromagnetic and physical properties selected to allow relatively high lamp voltages to be applied between the front and rear electrodes 11 and 14*a* respectively. This is to avoid breakdown in the phosphor caused by large voltage gradients through the thickness of the phosphor.

When an alternating voltage is applied across the front and rear electrodes 11 and 14*a*, a time-varying electric field is generated in the phosphor and dielectric layer. Electroluminescence occurs in the lamp by exciting phosphorus atoms, by means of the electric field, followed by decay to their ground state via the emission of radiant energy in the visible spectrum. The electroluminescence produced thereby, is transmitted through the transparent front electrode resulting in uniform illumination of the phosphorus layer.

In the case of single lamp display (i.e. a display having only one lamp element C), it is relatively straightforward to provide a conduction path to the rear electrode 14*a* to complete the power supply circuit. Conduction traces are provided connecting the front and rear electrodes to terminals at the edge of the electroluminescent lamp. However, where traces are run over exposed parts of the substrate, it is necessary to insulate the trace by providing a first dielectric insulator 30 between the phosphor and the rear electrode. The construction of this element will described in detail below.

Lamp elements may be powered by directly connecting the power supply to conductive areas on the lamp. Alternatively, the lamp may be powered by inductive power transfer (IPT) methods known in the art. Inductive power transfer may be particularly suitable in wet or damp environments or where, for safety reasons, it is necessary to have no physical conductive path between the power supply and the lamp itself.

Figure 2:
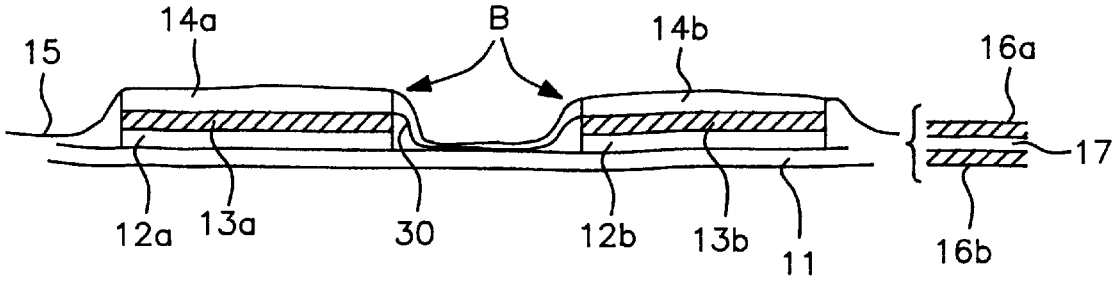
FIG. 2 illustrates a cross-section through a prior art electroluminescent lamp display with a conductive trace overlaid thereon.

Conventional EL lamps such as that shown in FIG. 2 may be fabricated according to the following technique:

An adhesion promoter such as "Vytel" may be deposited on the transparent front electrode layer. This layer assists in adhering trace and tail bridges to the front electrodes substrate in exposed areas where there is no image (i.e.; no phosphor or rear electrode). A colour corrected or doped phosphor layer is then printed onto the lamp. The image which is printed onto the EL lamp corresponds to the areas to be illuminated. The thickness of the phosphor layer may be 45 to 55 microns and be in the form of phosphor particles individually coated in a glass-like coating layer. This construction, termed microencapsulation, eliminates the need for a protective envelope to prevent moisture damage to the phosphor layer.

A dielectric layer is then overlaid onto the phosphor layer. The dielectric is the same shape (in plan) as the individual phosphor lamp elements. However, in a preferred embodiment, the dielectric may be approximately 2 mm larger around the perimeter of the phosphor layer. The thickness of the dielectric layer is approximately 14–18 microns.

In complex display topologies, there are typically many lamp elements constituting the electroluminescent display as a whole. In FIG. 1, a two element lamp is shown. In complex and/or large displays, it is usually necessary to run conduction tracks (or traces) over the lamp areas. These power supply traces must be insulated to prevent leakage current passing between the conduction track and the lamp electrode or section of exposed front electrode over which it passes. The traces must also be substantially capacitively inert so as not to interfere with the illumination properties of the lamp elements.

To this end, a first ultraviolet dielectric insulator 30 is next run as a bridge over the top of the dielectric. The deposition of this insulator is effected in three print passes. The UV dielectric insulators are typically elongate insulating paths traversing areas of the EL lamp in order to insulate conduction traces from lower layers. The first dielectric insulates traces from the first conductive layer (the front electrode) as well as building up the minimum insulating thickness between conductive layers at the back of the EL display.

A first silver conductive path (not shown) corresponding to the outer ground line (i.e. a bus bar) is deposited around the perimeter of the lamp. This is ultimately connected by traces running over the UV dielectric bridges between lamp elements and out to a termination area.

At this stage, electrodes 14*a* and 14*b* are also deposited over the lamp areas to complete each capacitive lamp circuit. The rear electrodes have shapes corresponding to the illuminated area (or phosphor shape) onto which they are deposited.

A second UV dielectric 16*b* or crossover is then deposited over the rear electrodes 14*a, b*. Then second silver conductive paths 17 (crossover traces) are run over the UV dielectric crossovers 16*b* and bridges 30 in order to link traces to traces or traces to lamps where direct access is either difficult or impossible. The thickness of this silver conducting layer is 20–25 microns.

Finally, a clear dielectric protective layer 16*a* is deposited on the back of the display as a whole to protect the display from moisture and also to serve as an insulator for the rear electrode. This component is shown in strip form in FIG. 4 to avoid obscuring the detail of the displays. Approximately 5 mm conduction trace lengths are left exposed at tail termination points to allow connection with the power supply or the bus bar.

This construction is shown in FIG. 2 whereby the traces 17, second UV layer 16*b*, and rear insulator 16*a* (collectively indicated by the numeral 15) are overlaid onto the top of the rear electrode 14*a*. The crossover trace provides a conduction path for the power supply. A first UV insulating dielectric 30 is sandwiched between the phosphor layer 13*a* and the rear electrode 14*a*. This aids in insulating the trace from the exposed areas of the front electrode (for example between lamp elements).

Using the prior art construction described above, the traces and corresponding insulation encounter a relatively large step when passing over a lamp element. These discontinuities are indicated by the figure B in FIG. 2 and can cause thinning in the deposited conduction trace 17 when this layer is deposited onto the EL lamp. Such thin spots are known to be prone to burnout resulting in lamp failure.

Figure 3:
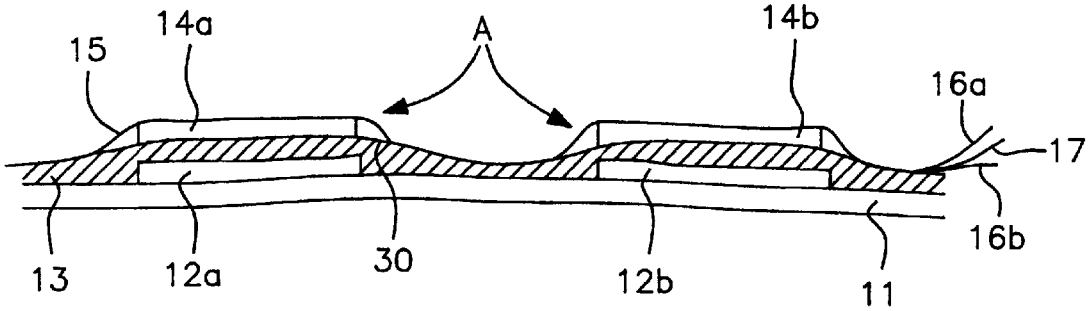
FIG. 3 illustrates a cross-section through an improved electroluminescent display incorporating a conductive trace.

For this reason and others which will be discussed below, the present invention includes a unitary white dielectric layer deposited uniformly over the lamp areas between the phosphor layer and the rear electrode. An example of such a lamp construction is illustrated in FIG. 3.

A novel fabrication process suitable for the production of such a lamp is as follows and described with reference to FIG. 3.

A blue green phosphor layer 12*a, b* is printed directly onto a conductive transparent or translucent substrate 11. The phosphor layer 12*a, b* is printed in areas corresponding to individual lamp elements as described above. The adhesion promoter may advantageously be omitted. Following this step, a white dielectric layer 13 is uniformly printed over the entire area of the display with the exception of reversed out region reserved for the silver conductive ground line (or bus bar).

The substantially uniform unitary layer of white dielectric 13 acts as an adhesion promoter for any UV dielectric layers at points where the UV dielectric is to be printed directly onto any non-lamp area of the EL display. Further, the uniform white dielectric 13 stops conductive traces 15 showing through the lamp on the viewing side.

A further advantage of such a construction is that the presence of a uniform, unitary white dielectric prevents termination failure. Prior art lamps previously have had UV dielectric insulating a conductive trace affixed to the transparent front electrode. This construction suffered from cracking at trace termination points.

The primary advantage of the modified display construction illustrated in FIGS. 3 and 4 is that the white dielectric flattens out the print profile. This can be seen to its best advantage in a comparison between FIG. 2 and FIG. 3 whereby the white dielectric layer eliminates thin spots in the silver conductive traces in areas where silver conductive trace encounters a transition from the exposed (or UV insulator coated) transparent front electrode to the multilayer EL lamp element. Prior art lamps exhibited steps of up to 60 microns at such discontinuities resulting in burnout and lamp failure.

The construction of lamps according to the present invention smooths out such steps this thus reducing or eliminating possibility of such burnouts. A cutaway perspective view of a simplified electroluminescent lamp incorporating the uniform white dielectric layer is shown in FIG. 4.

Referring to FIGS. 3 and 4, a first UV dielectric insulating layer 30 is printed to run under all connecting traces. This layer is deposited in a single print pass as opposed to the three passes required by prior art construction techniques. This layer prevents current leakage between the traces and the front electrode in areas between the lamp. The provision of conduction traces is generally as described as above. However, as noted above, only one UV dielectric insulating layer print pass is required due to the approximately 25 micron buildup of white dielectric which has been previously printed. A total layer gap of at least 30 microns is necessary between the substrate electrode and conductive traces. The present method also dispenses with the brittle, ultraviolet cured dielectric at the termination points. Instead, only white dielectric is deposited in the termination area.

A first silver conductive layer (14*a* and 14B) corresponding to the image is deposited over the uniform white dielectric layer and first UV dielectric insulators. These form the rear capacitor electrodes of each of the display lamps. The thickness of this electrode layer is 10–12 microns and the layer is printed with an image shape corresponding to that of the phosphor layer 12*a* and 12*b*. This is illustrated in a cutaway perspective view in FIG. 4.

A second UV dielectric crossover insulator 16*b* is then deposited over the silver electrodes. Again, these crossover insulators are generally elongate or have a shape defined by the image shape and the distribution of the necessary power supply conduction paths traversing various elements of the EL display.

Following this, silver conductive crossover traces 17 are deposited on the second UV trace insulators. This is followed by a UV dielectric protective layer 16*a* printed onto the entire back face of the EL display thus insulating both the silver crossover traces and the exposed silver image electrodes.

While the present invention is suitable for single or few element electroluminescent lamp displays, the most significant advantage is obtained in multi-element (or lamp) EL display topologies requiring a large number of crossovers and conduction trace elements.

Prototype multi-element EL displays fabricated by the applicant have contained up to 16 individually illuminated lamps or lamp subsets. A lamp subset correspond to a number of individual lamp elements powered by a single switched or multiplexed signal. Thus a lamp having a (for example) 16 separately illuminated lamp elements, or sets of lamp elements, will require a large number of crossovers and thus effective points of insulation between the conductive crossovers and the silver rear electrodes and exposed front electrode areas over which they pass. As has been noted above, prior art lamp constructions lead to burnouts occurring at transition boundaries between front electrode and lamp areas. Increasing the number of such transitions can lead to an unacceptably higher number of burnouts and thus lamp failures. The present invention allows the inclusion of significantly more crossovers with relative immunity thus allowing the manufacturer to produce extremely complicated and intricate lamp designs.

Further, the resilience of the displays manufactured according to the invention, specifically at the termination areas, is enhanced by the provision of the uniform white electric layer.

Thus by the present invention an improved electroluminescent display and method of producing the same is provided. The improvement uses readily available chemistry and is not considered to significantly increase the cost of lamp production. The ability to construct highly complex displays is an enhanced as is their durability and reliability.

Where in the foregoing description reference has been made to elements or integers having known equivalents, then such equivalents are included as if they were individually set forth.

Although the invention has been described by way of example and with reference to particular embodiments, it is to be understood that modifications and/or improvements may be made without departing from the scope or spirit of the appended claims.

What is claimed is:

1. An improved electroluminescent display including:

a first substantially transparent or translucent conductive layer;

a phosphor or the like layer deposited to form a multi-element display on the first conductive layer;

the phosphor layer is broken up into more than one area;

a layer of dielectric deposited upon the phosphor or the like layer, the dielectric covering substantially all of the display;

a second conductive layer deposited upon the dielectric layer;

said areas corresponding to areas of the electroluminescent display which are to be lit, and wherein the second conductive layer is comprised of a number of areas shaped to be substantially congruent with the shaped areas of the phosphor or the like layer.

2. An improved electroluminescent display as claimed in claim 1 wherein the first conductive layer is an Indium Tin Oxide layer deposited onto a substantially transparent or translucent polyester sheet.

3. An improved electroluminescent display as claimed in claim 1 wherein the layer of dielectric material is substantially opaque.

4. An improved electroluminescent display as claimed in claim 1 wherein the phosphor corresponds to a blue-green phosphor.

5. An improved electroluminescent display as claimed in claim 1 including conduction paths traversing the phosphor/conductive layer areas, the conduction paths being insulated from the first and second conductive layers by means of a plurality of dielectric insulators.

6. An improved electroluminescent display as claimed in claim 5 wherein the dielectric insulators correspond to a first dielectric layer interposed between the dielectric layer and a second conductive layer and a second dielectric layer deposited on the second conductive layer.

7. An electroluminescent display as claimed in claim 5 wherein the conduction paths are deposited on to the dielectric layer deposited onto the second electrode.

* * * * *